United States Patent [19]

Henricot

[11] 3,945,327

[45] Mar. 23, 1976

[54] SUSPENSION DEVICE FOR SIDE MEMBERS ON AXLE-BOXES FOR RAILWAY CARRIAGES OR SIMILAR APPLIANCES

[75] Inventor: Paul E. Henricot, Ceroux-Mousty, Belgium

[73] Assignee: Societe Anonyme Usines Emile Henricot, Court-Saint-Etienne, Belgium

[22] Filed: Nov. 5, 1974

[21] Appl. No.: 521,076

[30] Foreign Application Priority Data

Jan. 10, 1974 Belgium ..... 809587

[52] U.S. Cl. ..... 105/224.1

[51] Int. Cl.[2] ..... B61F 5/26

[58] Field of Search..... 105/218 R, 224.1, 220, 105/221 R

[56] References Cited

UNITED STATES PATENTS

| | | | |
|---|---|---|---|
| 3,682,104 | 8/1972 | Henricot | 105/224.1 |
| 3,720,175 | 3/1973 | French | 105/224.1 |
| 3,785,298 | 1/1974 | Reynolds | 105/224.1 X |

*Primary Examiner*—John J. Love

*Attorney, Agent, or Firm*—Bacon & Thomas

[57] ABSTRACT

The invention pertains to a suspension device of side members on axle-boxes for railway carriages, said side members having openings therein with a central bead, encompassing two lateral housings and the axle boxes being provided, at the front and at the rear, with a collar which forms a bead, rubber rolls being pressed in between the side housings of the side members by aforesaid collars, adaptors being fitted between said rolls and said boxes.

1 Claim, 7 Drawing Figures

Fig. 1
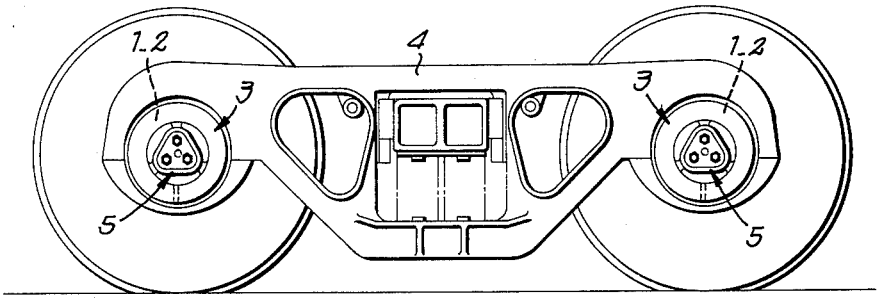
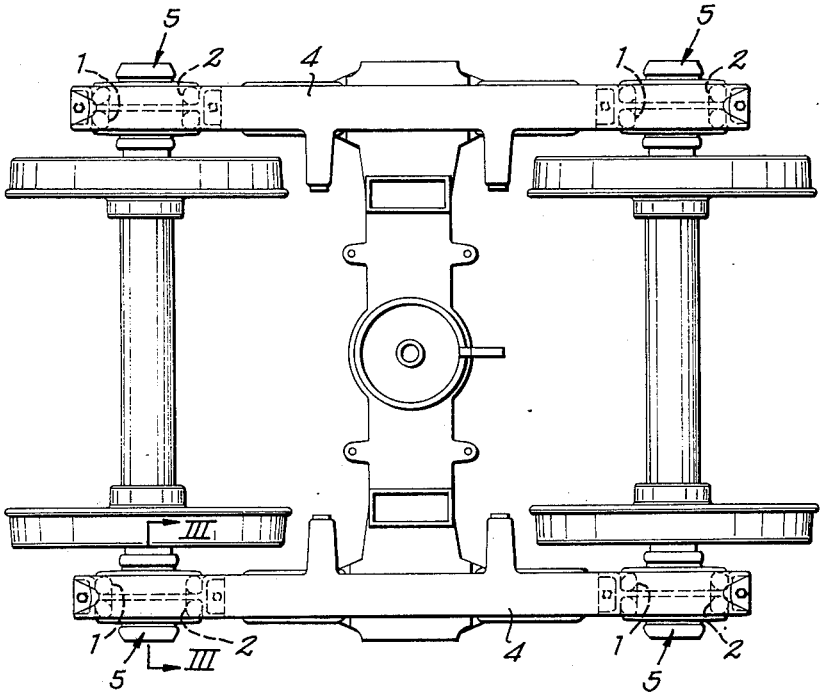
Fig. 2

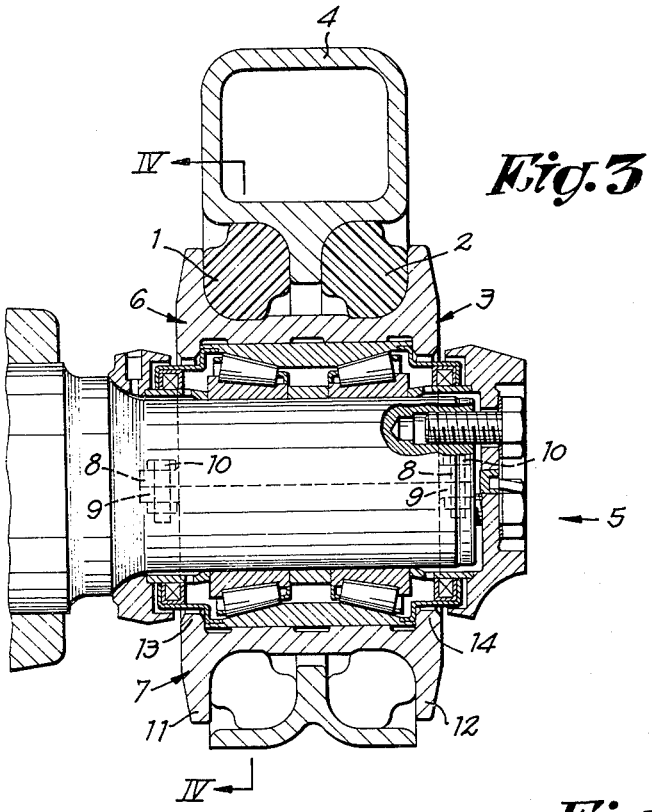
Fig. 3
Fig. 4
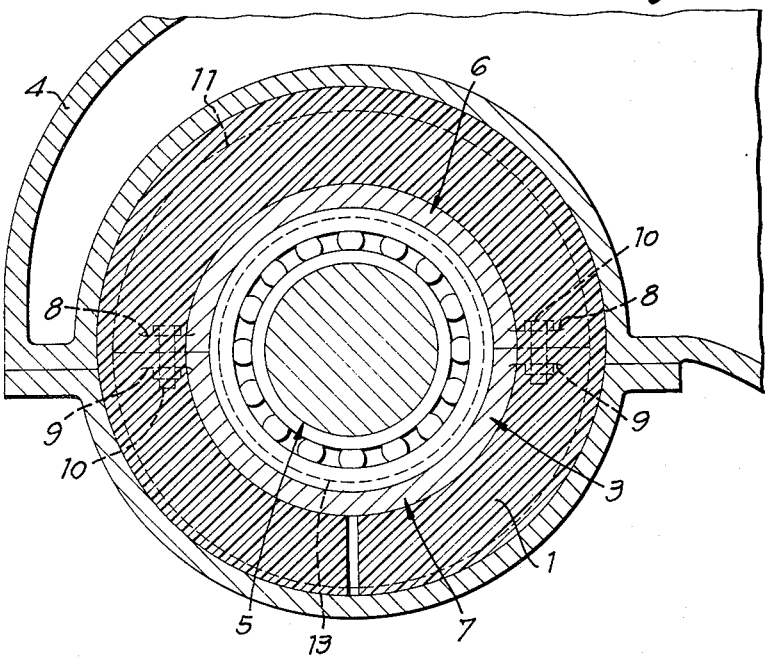

Fig. 5
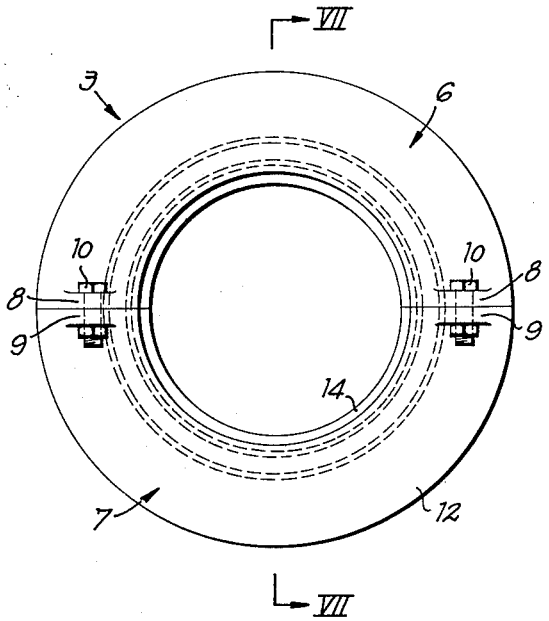
Fig. 7
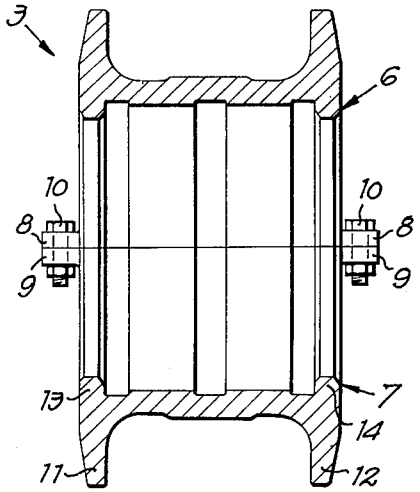
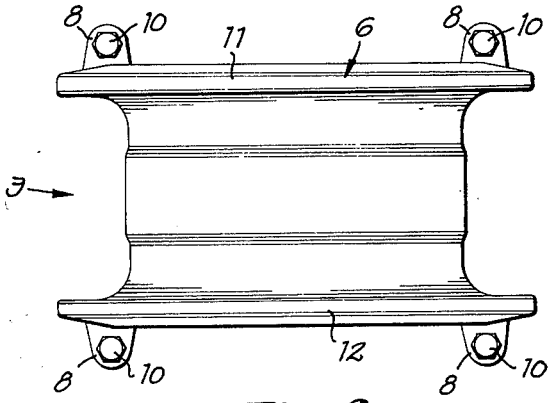
Fig. 6

SUSPENSION DEVICE FOR SIDE MEMBERS ON AXLE-BOXES FOR RAILWAY CARRIAGES OR SIMILAR APPLIANCES

The main patent reveals a suspension device of side members on axle-boxes for railway carriages or similar appliances, whereby this device is characterized by the fact that the housings in the side members consist of openings with a central bead, encompassing two lateral housings and the axle boxes are of a general cylindrical shape provided, at the front and at the rear, with a collar which forms a bead, rubber rolls being pressed in between said side housings of the side members by said collars of the axle-box.

One of the collars of the axle-box may be part of a cover which can be removed for the purpose of fitting or removing the suspension device. However, standard outwardly cylindrical axle-boxes currently exist, sometimes called cartridges, which do not have the circular ledges for supporting the rubber rings.

The subjects of the present invention are improvements which offer to this problem a simple solution, which is both efficient and economical.

These improvements can be adapted just as well for the fixing of complete annular elements as for the fixing of elastic ring portions. Aforesaid improvements consist in fitting, between the box and aforesaid elastic rings or ring portions, a special part which, for convenience's sake, will be called hereinafter an adaptor.

In the case of a complete ring, the adaptor is built in two parts, fitting on the one hand by means of its front surface against the cylindrical body of the box, and being provided on the other hand, on the outside and at both ends, with circular ledges which provide a support for elastic rings. In this case the adaptor is in two parts to enable the fitting thereof on the box. These two parts are for instance attached to each other by means of bolts. In order to prevent any disturbing lateral displacement of the adaptor with respect to the box, it is provided with an internal circular ledge at both ends. In the case of ring portions, on the other hand, the adaptor is made up of part of the adaptor used for complete elastic rings.

It is of course quite obvious that the adaptor may have shapes and dimensions which are essentially variable according to the suspension characteristics under consideration and to the load which has to be transmitted.

It is thus merely as an example, without the slightest intent at limitation, that a form of embodiment is described hereinafter in greater detail with reference to the appended drawings in which:

FIG. 1 shows a side view of the essential elements of a bogie to which have been applied the improvements which are the subject of the invention;

FIG. 2 is a top view thereof;

FIG. 3 is a section, to a larger scale, taken on line III—III in FIG. 2;

FIG. 4 shows a section taken on line IV—IV in FIG. 3;

FIG. 5 is a side view of an adaptor according to the invention;

FIG. 6 illustrates a top view of same;

FIG. 7 is a section taken on line VII—VII in FIG. 5.

In this form of embodiment, provided for the use of complete elastic rings 1–2, adaptor 3 is fitted between side member 4 and box 5 and is made up of two half shells 6–7 joined together by tabs 8–9 and bolts 10. The adaptor is such that it defines two outside border ledges 11–12 which are capable of providing support surfaces for elastic rings 1–2, which on the other hand press against the adjacent parts of aforesaid side member 4. Finally, each half of the adaptor is further provided with two inside border ledges, respectively 13–14, which prevent any inadvertent lateral displacement of the adaptor with respect to the box.

In the case of semi circular elastic ring portions, use will be made of an adaptor consisting of one single shell.

The invention is concerned, as a novel industrial product, with any adaptor consisting of a complete annular element or of a semi-annular element, as well as with any suspension which applies such an adaptor.

What I claim is:

1. A suspension device for a railway carriage having a side frame and a generally cylindrical axle box, comprising:

said side frame having a circular portion spaced from and surrounding said axle box and provided with an inwardly extending circumferential central rim and inwardly facing circumferential recesses on opposite sides of said rim;

said axle box having axially spaced circumferential shoulders;

an adaptor comprising semi-cylindrical portions, releasably secured together, surrounding said axle box and having inner peripheral ledge portions engaging said shoulders to prevent axial displacement of said adapter relative to said axle box;

said adaptor having outwardly extending circumferential rims adjacent the axial ends thereof; and circular rubber beads, between said adaptor and circular portion of said frame, seated in said recesses and being held on said adaptor by said circumferential rims.

* * * * *